United States Patent [19]

Lee

[11] Patent Number: 4,572,034

[45] Date of Patent: Feb. 25, 1986

[54] CORK SCREW

[76] Inventor: Wen-Hsin Lee, 4th Fl., No. 61, Liu Ho I Rd., Kaohsiung City, Taiwan

[21] Appl. No.: 673,641

[22] Filed: Nov. 21, 1984

[51] Int. Cl.[4] ..... B67B 7/18

[52] U.S. Cl. ..... 81/3.29; 81/3.45

[58] Field of Search ..... 81/3.29, 3.36, 3.45, 81/3.48

[56] References Cited

U.S. PATENT DOCUMENTS

| | | | |
|---|---|---|---|
| 401,672 | 4/1889 | Alvord et al. | 81/3.29 |
| 884,873 | 4/1908 | Stanton | 81/3.29 |
| 1,012,931 | 12/1911 | Syme | 81/3.29 |
| 2,342,156 | 2/1944 | Miller | 81/3.29 |

*Primary Examiner*—James L. Jones, Jr.

*Attorney, Agent, or Firm*—Millen & White

[57] ABSTRACT

An improved cork screw which comprises a rotary handle and a cork penetrating spiral member encased in an upper hollow shank and a lower bell-shaped pedestal which can be seated on a bottle. A cork pulling lever is attached to the top of the spiral member and threaded through two diametrically opposite longitudinal apertures provided in the wall of the hollow shank. It is separably fitted to the bottom side of the handle and movable upward or downward along the longitudinal apertures. When the cork is to be pulled out, the user may hold the handle with his one hand and pull the lever towards the handle with his two fingers, thereby facilitating the cork's removal.

6 Claims, 4 Drawing Figures

CORK SCREW

BACKGROUND OF THE INVENTION

This invention relates to a cork screw, particularly to one having means for encasing its harmful penetrating screw and a cork pulling lever operable with its handle.

A known cork screw typically includes a penetrating spiral member or screw and a handle used for turning the spiral member, as shown in FIG. 1. Such a cork screw has a disadvantage in that it can not be controllably manipulated when pulling the cork from the bottle, that is, the pulling force applied may be so excessive that it may cause the bottle uncontrollable or even cause injury to the user. In some cases, the bottle may slip out of the user's hand and become broken. Further, the pointed screw which is thereby exposed may cause harm to the user.

SUMMARY OF THE INVENTION

An object of the invention is to provide a safety cork screw which can be controllably manipulated.

This and other objects can be achieved in accordance with the invention through the provision of a cork screw which comprises a rotary handle; a hollow shank of which the wall is provided with two opposite longitudinal apertures and of which one end is fixedly attached to the handle; a bell-shaped pedestal attached to the other end of the hollow shank and adapted to be seated on the top of a bottle, the pedestal being longitudinally movable but not releasable relative to the shank; a cork penetrating spiral member encased in the hollow shank and the pedestal; and a cork pulling lever attached to the top end of the spiral member and passing through the apertures, the pulling lever being separably fitted to the bottom side of the rotary handle and movable along the apertures.

The hollow shank may include a bottom flanged end, an annular groove above said flanged end, and a segmented spiral groove means upwardly extended from the annular groove.

The pedestal may include a tapered upper portion slidably sleeved onto the hollow shank, an annular shoulder at its lower portion, and engaging spring means provided in the tapered portion and inwardly projected for engaging in the annular groove.

The rotary handle may have a recess at its bottom side, and the cork pulling lever may include a pin member passing through the top portion of the cork penetrating spiral member and the longitudinal apertures, and two knobs attached to both ends of the pin member and releasably engaged with the recess.

The presently exemplary preferred embodiment will be described in detail with reference to the accompanying drawings, in which:

DETAILED DESCRIPTION OF THE PREFERRED EMBODIMENT

Figure 3:
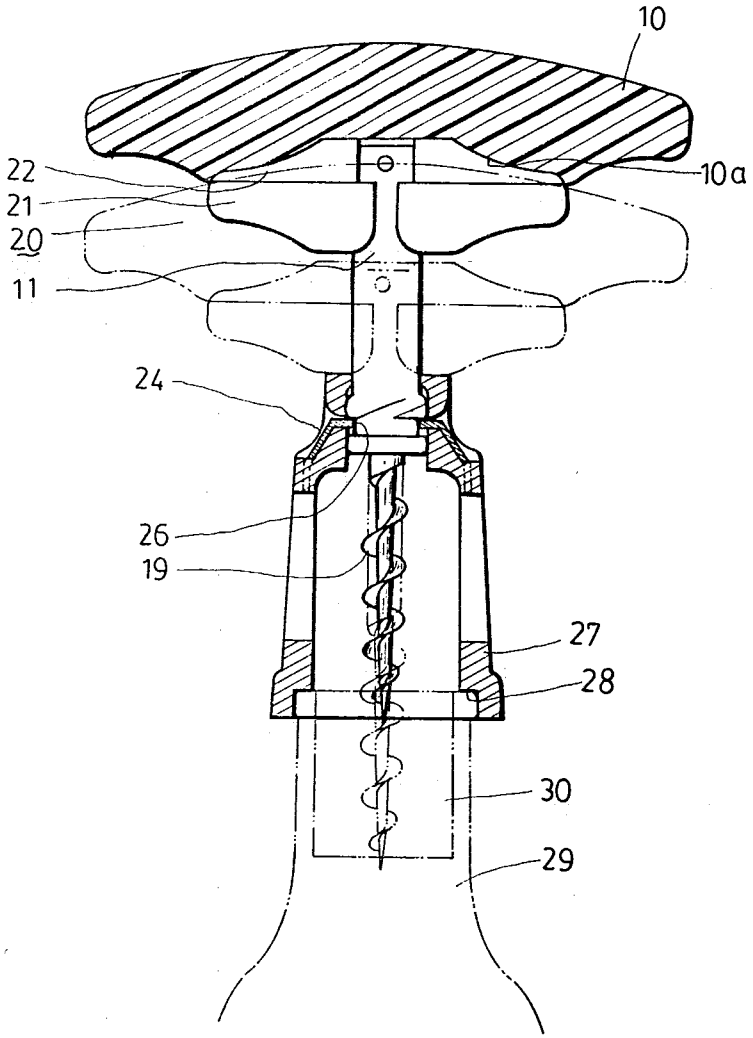
FIG. 3 is a sectional view of the cork screw of the same embodiment as FIG. 2.
Figure 1:
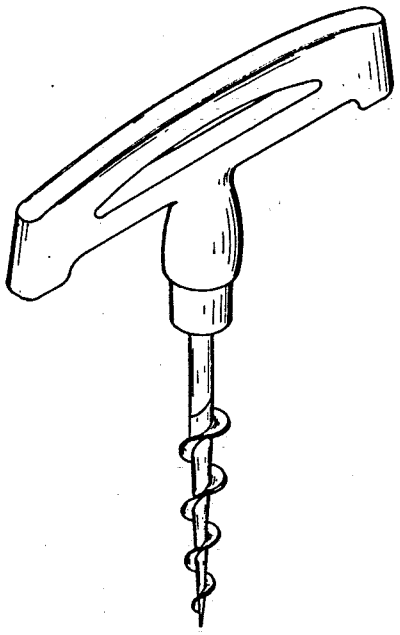
FIG. 1 is a perspective view of a cork screw of the prior art.
Figure 2:
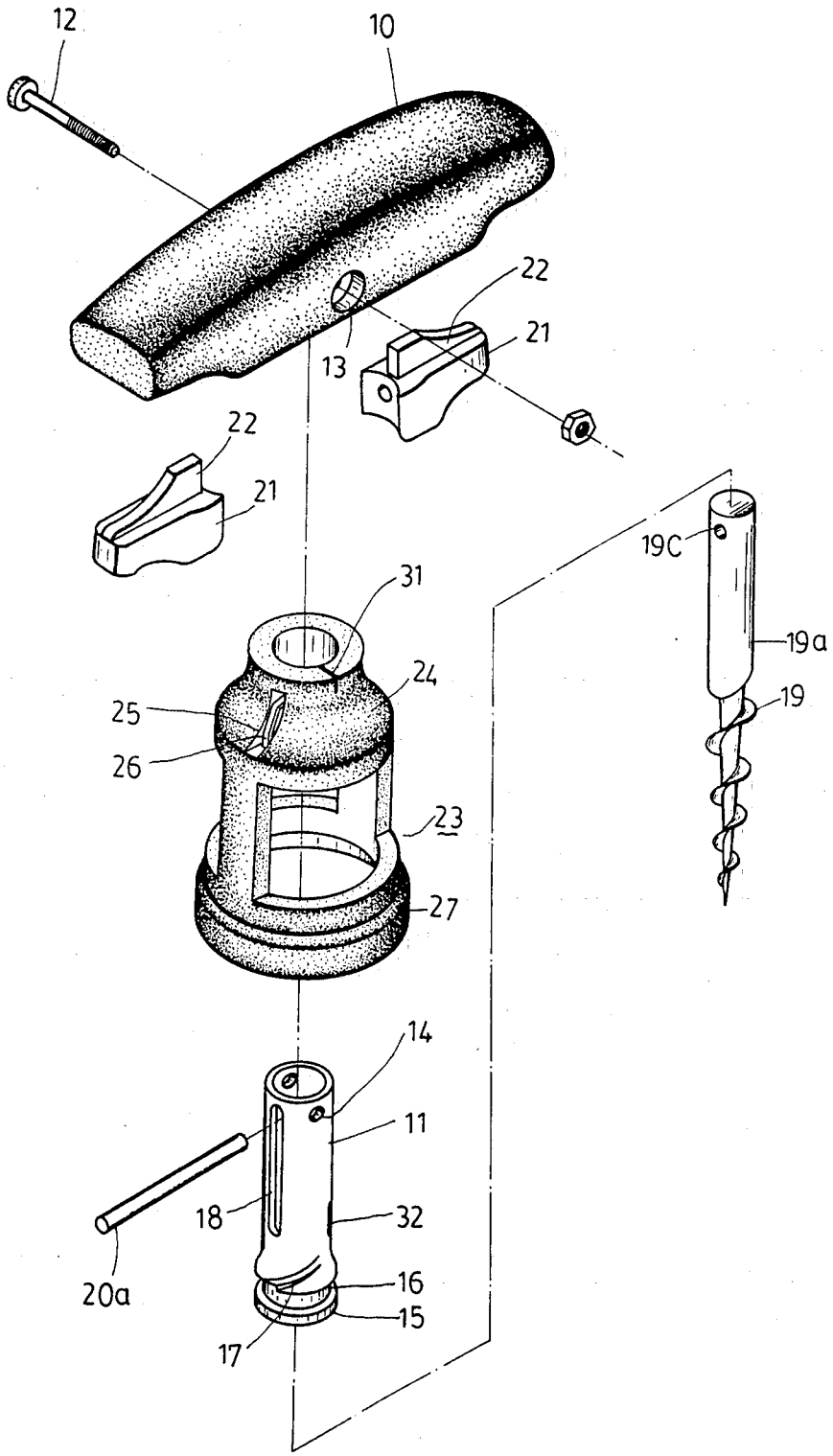
FIG. 2 is an exploded view of a cork screw constructed according to the invention.

Referring to the drawings, there is shown a cork screw which includes a rotary handle 10 to which is fixedly attached a hollow cylindrical shank 11 by means of a screw 12 passing through two holes 14 of the shank 11. The hollow shank 11 is provided with a flanged end 15, an annular groove 16, two diametrically opposite segmented spiral grooves 17 which are upwardly extended from the groove 16 and two diametrically opposite elongated guide apertures 18.

Inside the hollow shank is provided a cork penetrating spiral member 19 with a shank portion **19*a*. A cork pulling lever 20 is attached to the cork penetrating spiral member 19. The cork pulling lever includes a pin member 20*a* threaded through apertures 18 and a hole 19*c* in the shank portion 19*a*. At both ends of the pin member 20 is attached two knobs 21 each of which has a top projection 22 adapted to be detachably fitted into two recesses 10*a* at the bottom sides of the handle 10**.

At the bottom end of the hollow shank 11 is provided a bell shaped pedestal 23. The bell shaped pedestal 23 has its upper tapered portion 24 sleeved onto the hollow shank 11 and provided with two diametrically opposite recesses 25 each of which receives a spring plate 26. The inwardly projecting ends of the spring plates 26 are biassed to be engaged in annular groove 16 of the hollow shank 11. If the shank 11 is rotated to a predetermined angular distance, each spring plate 26 will be released from the groove 16 through a path guided by each segmented spiral groove 17, thereby enabling the shank 11 to move upward or downward relative to the pedestal 23.

On the inner side of the wall of the lower portion of the pedestal 23 is an annular shoulder 28 which is adapted to be seated on the top end of a bottle 29 when the device is mounted on the bottle.

In operation, the pedestal 23 is mounted on the bottle and the handle 10 is rotated, turning the cork pulling lever as well as the cork penetrating spiral member. When the handle 10 is rotated to about one-half turn, the annular groove 16 of the shank 11 disengages from the ends of the spring plates 26, thereby enabling the shank 11 to move downward relative to the pedestal 23. The continuing rotation of the handle causes the cork penetrating spiral member 19 to move downward together with the shank 11 and to penetrate into the cork 30 until the knobs 21 contact against the top of the pedestal 23. Thereafter, the handle 10 is pulled upward together with the shank 11. Since the cork penetrating member 19 is engaged in the cork 30, the cork pulling lever 20 separates from the handle 10 and remains immobile. At the end of the movement of the shank 11, the ends of the spring plates 26 engages with the annular groove 16 again, thereby locking the shank 11 against the movement relative to the pedestal 23.

To prevent the ends of the spring plates 26 from releasing through segmented spiral grooves 17 from the annular groove 16, it is preferable to provide indicator marks 31 and 32 respectively on the pedestal 23 and on the shank 11. The user may prevent releasing the spring plates 26 by turning the handle 10 to put the mark 32 in an unaligned position with respective to the mark 31.

When the shank 11 is locked against movement relative to the pedestal 23, the user may grip the handle 10 with his one hand and pull on the cork pulling lever 20 by using his two fingers until it abuts against the handle 10 to pull out the cork. At completion of the movement of the lever 20, the lever 20 is again attached to the handle 10. It can be appreciated that the aforementioned device is safe since the harmful cork penetrating screw member is encased in the hollow shank and in the pedestal, and that the device can be controllably manipulated because of the presence of the cork pulling lever.

Figure 4:
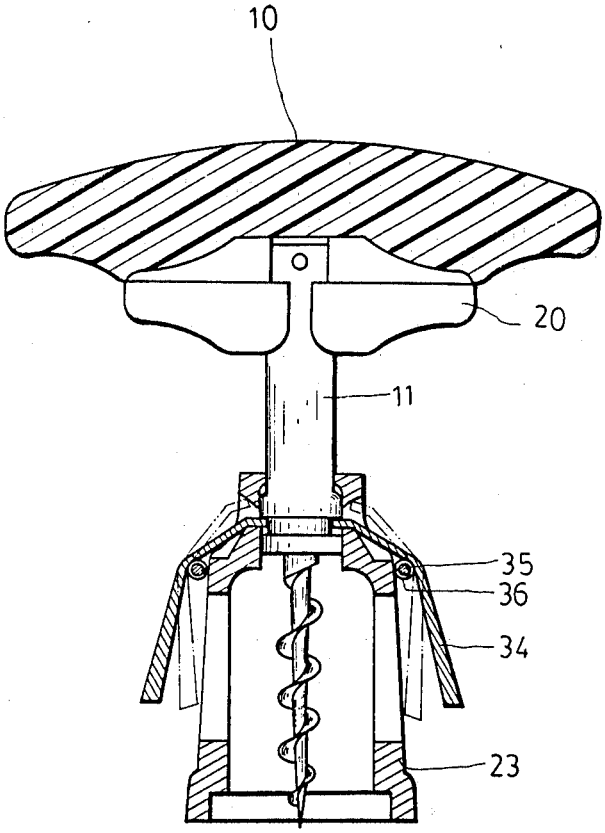
FIG. 4 shows another embodiment of the invention.

Referring to FIG. 4, there is shown another embodiment of the invention which includes elements substantially similar to those included in the above-mentioned embodiment except that the engaging spring means includes two spring biassed engaging plates 34. The plates 34 is mounted on a pin 35 which is movably mounted to the pedestal 23 by a known manner. On the pin 35 is further attached a spring coil 36 of which one end is fixed to the pedestal and of which another end is attached to the plates 34. The spring coil 36 normally biasses the upper end of the plate 34 to project into the recess 25 of the pedestal 23. When the lower portion of the plate 34 is depressed toward the pedestal 23, the upper portion of the plate 34 moves against the biassing action of the spring coil 36, thereby enabling the hollow shank 11 to move downward relative to the pedestal 23.

With the invention thus explained, it is apparent that various modification and variation can be made without departing from the scope of the invention. It is therefore intended that the invention be limited as indicated in the appended claims.

I claim:

1. A cork screw comprising: a rotary handle; a hollow shank of which the wall is provided with two opposite longitudinal apertures and of which one end is fixedly attached to said handle; a bell-shaped pedestal attached to the other end of said hollow shank and adapted to be seated on the top of a bottle, said pedestal being longitudinally movable but not releasable relative to said shank; a cork penetrating spiral member encased in said hollow shank and said pedestal; and a cork pulling lever attached to the top end of said spiral member and passing through said apertures, said pulling lever being separably fitted to the bottom side of said rotary handle and movable along said apertures.

2. A cork screw as claimed in claim 1, wherein said hollow shank includes a bottom flanged end, an annular groove above said flanged end, and segmented spiral groove means upwardly extended from said annular groove.

3. A cork screw as claimed in claim 2, wherein said bell-shaped pedestal includes a tapered upper portion slidably sleeved onto said hollow shank, an annular shoulder at its larger lower portion, and engaging spring means provided in said tapered portion and inwardly projected for engaging in said annular groove.

4. A cork screw as claimed in claim 1, in which said rotary handle has a recess at its bottom side, wherein said cork pulling lever includes a pin member passing through the top portion of the cork penetrating spiral member and said longitudinal apertures, and two knobs attached to both ends of said pin member and releasably engaged with said recess.

5. A cork screw as claimed in claim 1, wherein said hollow shank includes a bottom flanged end, and an annular groove above said flanged end.

6. A cork screw as claimed in claim 5, wherein said bell-shaped pedestal includes a tapered upper portion slidably sleeved onto said hollow shank and having a recess in its wall, an annular shoulder at its larger lower portion, and engaging means mounted to said pedestal and normally biassed to project into said tapered upper portion through said recess for engaging in said annular groove.

* * * * *